US009982499B2

(12) United States Patent
Fleischhacker et al.

(10) Patent No.: US 9,982,499 B2
(45) Date of Patent: May 29, 2018

(54) METHOD AND APPARATUS FOR CLEARING A WELLBORE

(71) Applicant: Quantum Downhole Systems Inc., Calgary (CA)

(72) Inventors: Dean Fleischhacker, Calgary (CA); Mike Mazerolle, Calgary (CA); Steven Winkler, Cochrane (CA)

(73) Assignee: Quantum Downhole Systems Inc., Calgary (CA)

( * ) Notice: Subject to any disclaimer, the term of this patent is extended or adjusted under 35 U.S.C. 154(b) by 149 days.

(21) Appl. No.: 15/056,881

(22) Filed: Feb. 29, 2016

(65) Prior Publication Data

US 2017/0247967 A1 Aug. 31, 2017

(51) Int. Cl.
*E21B 10/42* (2006.01)
*E21B 29/00* (2006.01)

(52) U.S. Cl.
CPC ..... *E21B 29/00* (2013.01); *E21B 10/42* (2013.01)

(58) Field of Classification Search
CPC ..... E21B 29/00; E21B 29/002; E21B 10/42; E21B 12/06; E21B 17/06; E21B 17/006; E21B 19/00
See application file for complete search history.

(56) References Cited

U.S. PATENT DOCUMENTS

2016/0040495 A1* 2/2016 Mahajan ..... E21B 10/42 166/376
2017/0218705 A1* 8/2017 Nkwocha ..... E06B 9/84

* cited by examiner

*Primary Examiner* — D. Andrews
*Assistant Examiner* — Yanick A Akaragwe
(74) *Attorney, Agent, or Firm* — Bookoff McAndrews, PLLC

(57) ABSTRACT

A method and a downhole apparatus for clearing a wellbore are disclosed. The method locates a mill in the wellbore about the obstructions, introduces a driving fluid flow along a driving flow path from surface to the mill, and introduces a circulation fluid flow along a circulation flow path from surface into a wellbore annulus at a location in the wellbore above the mill. Then the mill is driven by the introduced driving fluid flow to mill the obstructions; and milled obstructions are circulated to the surface via the wellbore annulus using the introduced circulation fluid and gas flow. At least a portion of the circulation flow path is within the driving flow path.

11 Claims, 6 Drawing Sheets

METHOD AND APPARATUS FOR CLEARING A WELLBORE

FIELD OF THE DISCLOSURE

The present disclosure is related to the field of methods and apparatuses for clearing a wellbore, and in particular to methods and apparatuses for clearing a wellbore using milling and circulation, in combination with the use of dual coiled tubing or multi-string spoolable coiled tubing.

BACKGROUND

Since recent developments in the fields of horizontal drilling and multistage fracturing many Exploration and Production (E&P) operators have experienced difficulties utilizing current technologies to mill or drill the balls and ball seats out of the ball frac sleeves of an open hole ball-type frac liner system completed into a formation or reservoir. The restriction caused by these balls and ball seats prevent optimal productivity of the well and can prevent the E&P companies from entering the liner of the wellbore. Recent developments indicate that a work-over or intervention is required to remove the restrictions (balls and seats), to investigate inflow (production log or production evaluate), to re-stimulate the reservoir, and/or remove blockages such as sand or formation material.

Currently, the technology being used in these situations is typically conventional coiled tubing, water and nitrogen mixtures, and mud motors equipped with drill-bits or mills. These systems can increase the diameter of the liner by removing balls, seats, or other obstructions to achieve a maximum inner diameter of the liner. Current processes, however, create an over-balanced effect/position on the reservoir which in turn can lead to a loss of work-over fluids, such as into the formulation. A loss of work-over fluids can result in the undesired effect of frac proppant (sand) coming out of suspension and "sanding-in" tools and tubing so that they cannot be removed. Sanding-in can result in the entire loss of tools, expensive fishing requirements, and potentially the loss of production from the well which can no longer be accessed. This over-balanced effect can also lead to formation damage resulting in reduced inflow from the formation. The wellbore is often left debris still present and not cleared from the liner, including solids from the seats, frac proppant (sand) and formation fines. This limits the E&P companies from operating the well at its maximum productivity and interferes with the gathering of valuable data that would facilitate optimal development of a given field.

Mixture of water and gas, such as nitrogen, is often circulated downhole to reduce hydrostatic preserve and lift debris to surface.

For E&P companies who are presently doing these operations, the cost and supply of nitrogen can seriously impact the economics and overall outcome. Safety is also major concern for E&P companies using current systems and the operations environment can be categorized as moderate to high risk. One reason for the safety concern is that the injection lines, coiled tubing, and return lines, containing the highly compressible nitrogen can be under extreme pressure. If a pressurized line or tubing is to part or break, the energy stored in the volume of the lines explosively discharges. This sudden release can cause the lines to whip uncontrollably until the energy has bled off. The uncontrolled movement of the lines can, in turn, contact and injure personnel and/or damage other equipment. The choice fluid, a liquid/gas mixture, typically used during current operations is low in density to maintain high velocity. However, in turn, it is also known to wash out the surface iron (coiled tubing reel), flow back vessel manifolds and connections.

Accordingly, there is a need to provide apparatus and methods for clearing a wellbore that can overcome the short-comings of the prior art, such as unstable job economics, potential for formation and equipment damage, and unsafe work environments.

SUMMARY

Methods and downhole tool are provided for clearing a wellbore during milling and fluid circulation within a wellbore. Obstructions such as balls, seats, bridge plugs, or formation material can be milled within a wellbore, including a liner in a wellbore. As a result, larger, unrestricted, diameters can be obtained within the wellbore. The cleared wellbore can allow for various remedial tools to be run into the liner/wellbore. The milled particles can be circulated to surface. The downhole tool can be deployed using a spoolable single or multi-conduit coiled tubing system and can be configured as a well intervention or work-over technology. In some embodiments, the downhole tool can be temporary or mobile.

The downhole tool disclosed herein comprises an outer tubing connector and an inner tubing connector received in a bore of the outer tubing connector, for respectively coupling to an outer tubing string and an inner tubing string received in a bore of the outer tubing string. The annulus between the inner and outer tubing strings forms a driving flow path for introducing a driving fluid flow downhole to a mill, and the bore of the inner tubing string forms a circulation flow path, for introducing a circulation fluid flow downhole for circulation debris to the surface. A flow diverter firstly directs the driving fluid flow to the mill via one or more axially extending driving flow passages, and secondly directs the circulation flow path into a wellbore annulus for debris circulation to surface via a flow redirector and one or more radially extending circulation flow passages.

The driving fluid may be a liquid such as drilling mud. The circulation fluid may be a gas such as nitrogen.

In some embodiments, the downhole tool disclosed herein also comprises a bottom sub and a mill release sub intermediate the bottom sub and the mill for releasing the mill in emergency situations. The bottom sub comprises a piston received in a bore thereof. The piston is normally locked at an uphole, operation position by shear pins, and may be axially movable to a downhole, emergency release position. The piston is coupled to the flow redirector, which in these embodiments is also axially movable between at an uphole, operation position and a downhole, emergency release position.

In emergency situations, such as when the mill is stuck in downhole debris, a ball may be dropped or pumped through the inner tubing string to block the circulation flow path of the movable flow redirector. Gas is then highly pressurized and applies a sufficient downhole force to the flow redirector and in turn the piston for shearing the shear pins and unlocking the piston. The piston, and a downhole tubular coupled thereto, is then actuated downhole to trigger the mill release sub for releasing the mill.

The downhole tool disclosed herein reduces the risks related to pressurized nitrogen, avoids wash-out and allows the use of a small diameter inner tubing string for controlled nitrogen use, leading to significant cost saving.

According to one aspect of this disclosure, there is provided a downhole apparatus for clearing a wellbore. The apparatus comprises: a first tubing forming a first flow path; a second tubing, the first tubing received in a bore of the second tubing, and forming a second flow path along the annulus formed therebetween; a flow diverter connecting distal ends of the first and second tubings; and a mill connected to a downhole end of the flow diverter; wherein the flow diverter comprises a driving flow path therethrough and in fluid communication with the mill, and a circulation flow path in fluid communication with an annulus of the wellbore.

In some embodiments, the first flow path is the circulation flow path and the second flow path is the driving flow path.

In some embodiments, the apparatus further comprises: a mill release sub coupled to and intermediate the flow diverter and the mill; and a piston intermediate the flow diverter and the mill release sub, the piston actuatable, by the circulation flow path through the flow diverter, between a first position for normal operation and a second position for triggering the mill release sub to release the mill.

In some embodiments, the flow diverter further comprises a flow redirector movable between a third position for directing the circulation flow into the annulus of the wellbore and a fourth position for actuating the piston to telescope downhole for releasing the mill.

In some embodiments, the flow redirector further comprises a ball seat for receiving a ball through the first tubing for actuating the flow redirector to move to the fourth position.

In some embodiments, the flow redirector further comprises one or more one-way valves for only allowing fluid to flow downhole.

In some embodiments, the piston further comprises a bore and one or more ports for directing driving fluid flow into the bore of the piston.

In some embodiments, the piston further comprises one or more one-way valves for only allowing fluid to flow downhole.

According to another aspect of this disclosure, there is provided a method of clearing obstructions in a wellbore. The method comprises: locating a mill in the wellbore about the obstructions; introducing a driving fluid flow along a driving flow path from surface to downhole for driving the mill; introducing a circulation fluid flow along a circulation flow path from surface into the wellbore annulus at a location in the wellbore above the mill; driving the mill using introduced driving fluid flow to mill the obstructions; and circulating milled obstructions to the surface via the wellbore annulus using the introduced circulation fluid flow; wherein at least a portion of one of the circulation and the driving flow paths is within the other one of the circulation and the driving flow paths.

In some embodiments, at least a portion of the circulation flow path is within the driving flow path.

DETAILED DESCRIPTION

Figure 1:
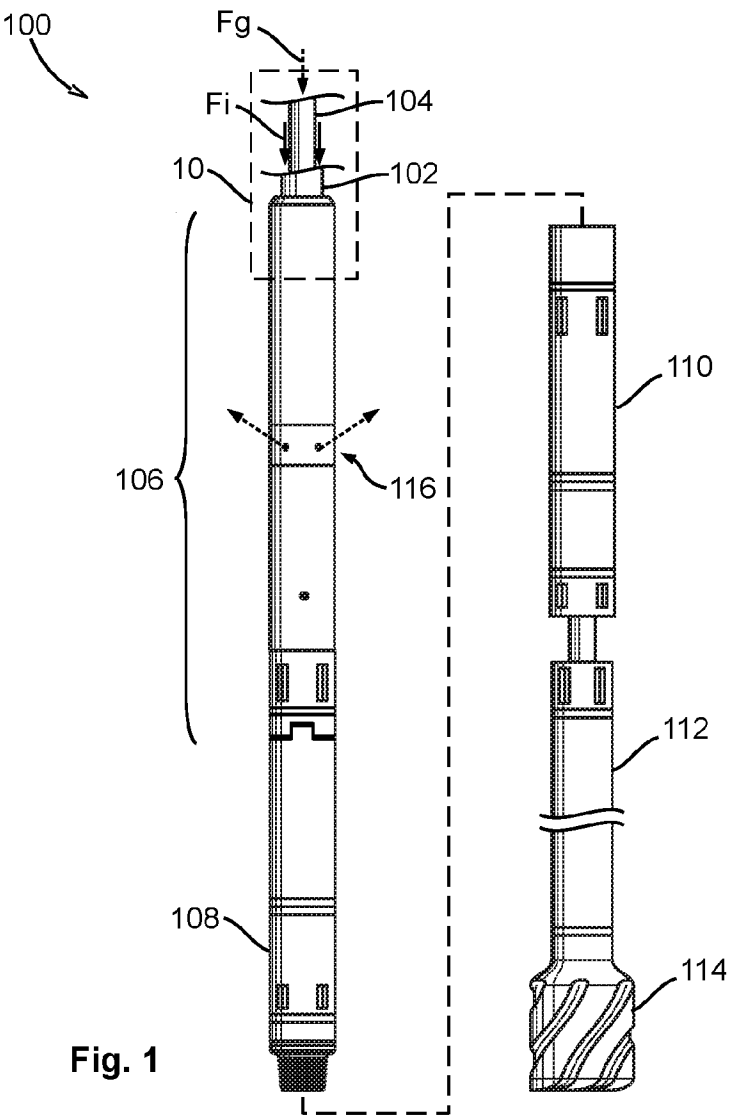
FIG. 1 illustrates a portion of a tubing string having a downhole tool for milling and clearing debris from a wellbore.

Turning now to FIG. 1, a downhole tool 100 such as a bottom hole assembly (BHA) is shown, and the components of which are described from an uphole direction to a downhole direction. The downhole tool 100 is located at a distal end section of a tubing string 10. As shown, the tubing string 10 comprises an outer tubing 102 and an inner tubing 104 received therein. The outer and inner tubing strings 102 and 104 are coupled to a dual-tubing assembly 106 and are in fluid communication therewith.

The dual-tubing assembly 106 is in turn coupled to and in fluid communication with a hydraulic motor 112, such as a mud motor, through intermediate subs, such as a milling release tool 108 and a tubing jar 110. The hydraulic motor 112 drives a mill or drill-bits 114 at a downhole end of the tubing string 10 for milling or drilling obstructions such as balls, seats, bridge plugs, or formation material.

Herein, the dual-tubing assembly 106 establishes a driving flow path for introducing a flow of driving fluid Fi, which may be an incompressible driving liquid such as drilling mud. The driving fluid Fi is provided from the surface to the hydraulic motor 112 for rotationally driving the mill 114. The dual-tubing assembly 106 also establishes a circulation flow path for introducing a flow of circulation fluid Fg, which may be a compressible gas, such as nitrogen, from the surface and into the wellbore at a circulation fluid jet position 116 uphole of the mill 114. The circulation fluid Fg is introduced to the downhole tool 100 to circulate milled obstructions and other debris to the surface.

Figure 2:
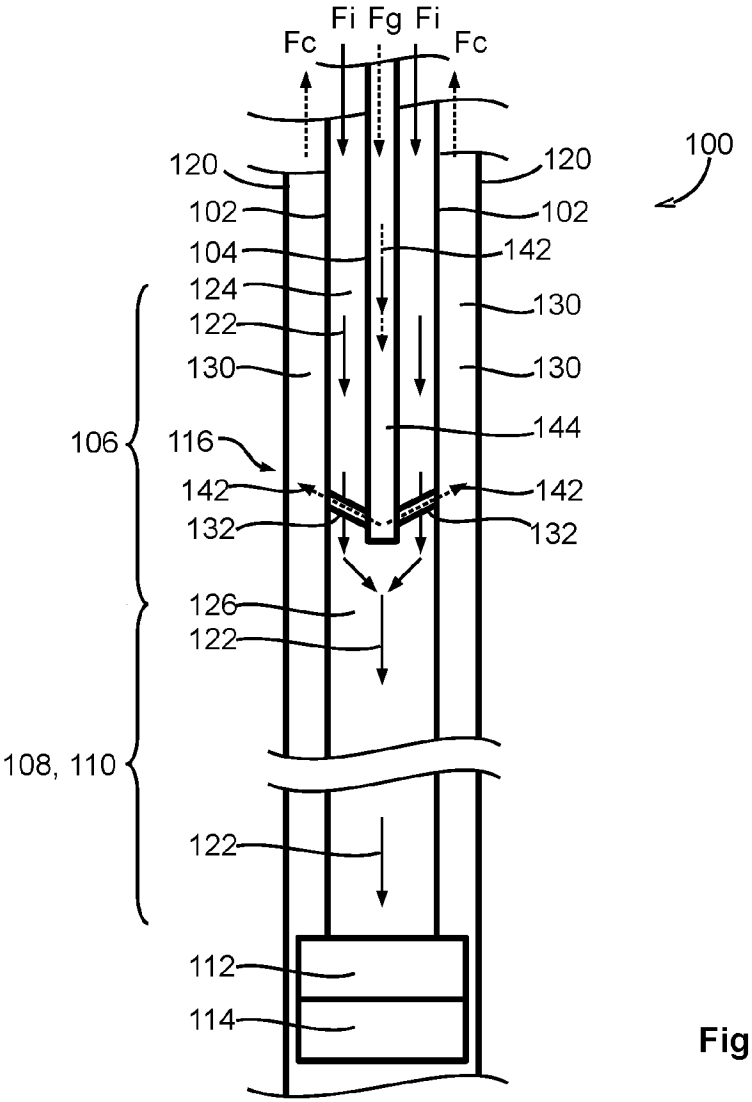
FIG. 2 is a schematic cross-sectional portion of the structure and the flow paths of the downhole tool of FIG. 1, according to one embodiment.

With reference to FIG. 2, the downhole tool 100 is located in a wellbore 120. Driving and circulation flow paths 122 and 142 are shown for driving fluid Fi and circulation fluid Fg. For ease of illustration, the milling release tool 108 and the tubing jar 110 are not shown therein.

As shown in the embodiment of FIG. 2, the driving flow path 122 is established from the surface through a tubing annulus 124 between the outer and inner tubing strings 102 and 104, and through a channel 126 through the dual-tubing assembly 106 and intermediate subs, to the hydraulic motor 112, introducing driving fluid Fi drive the mill 114.

The inner tubing 104 terminates in the downhole tool 100 at the circulation fluid jet position 116, uphole of the mill 114, and is fluidly connected to the wellbore annulus 130 between the downhole tool 100 and the wall, liner or casing of the wellbore 120, via one or more generally radial circulation passages 132. A circulation flow path 142 is then established from the surface, through the bore 144 of the inner tubing 104, the one or more circulation passages 132, and the wellbore annulus 130 back to the surface. The circulation flow path 142 introduces the circulation fluid Fg to the wellbore annulus 130 and to the surface as a circulation flow Fc.

The driving flow path 122 is fluidly separated from the circulation flow path 142.

Figure 3:
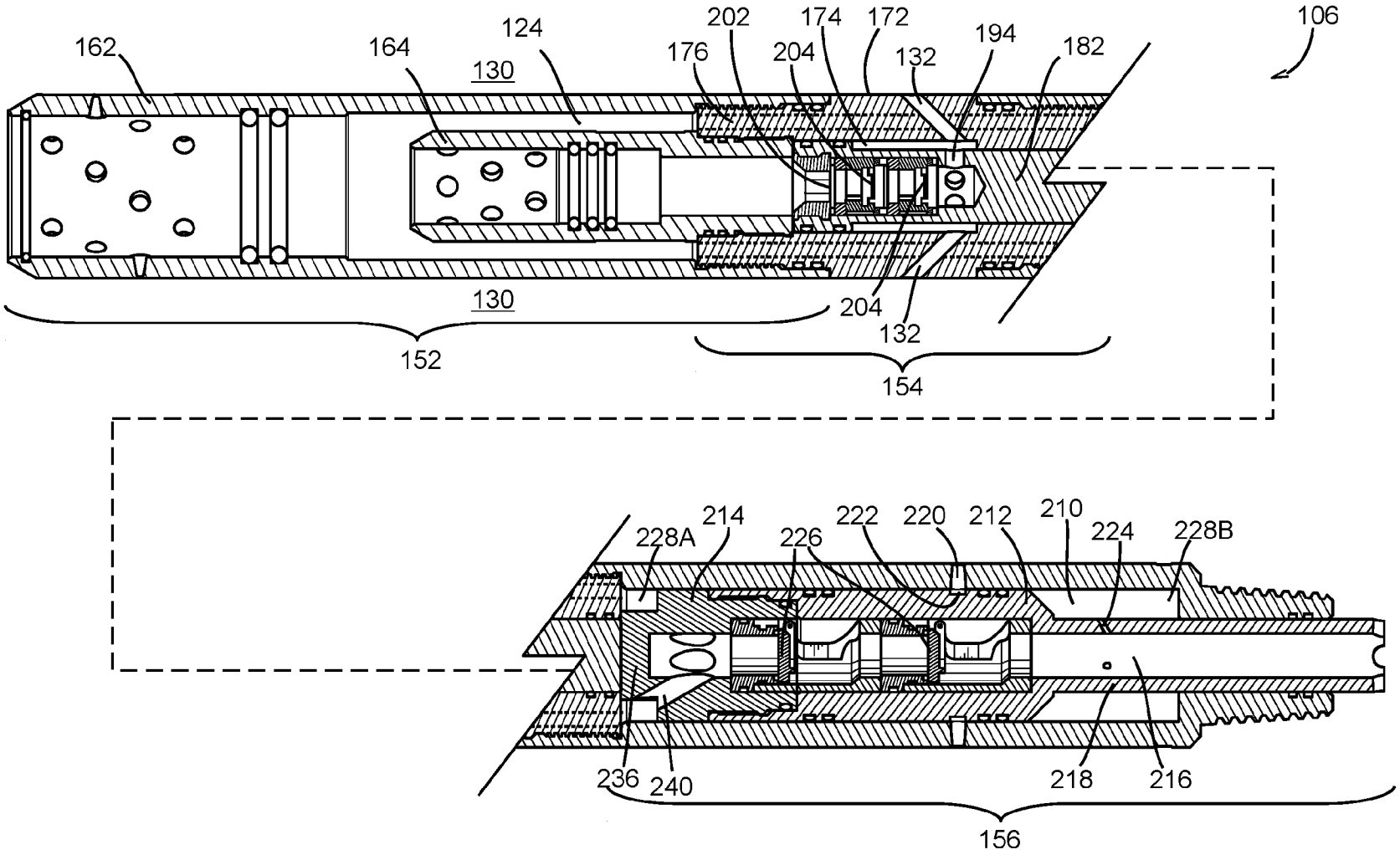
FIG. 3 is a cross-sectional view of an example of a dual-tubing assembly of the downhole tool of FIG. 1.
Figure 4:
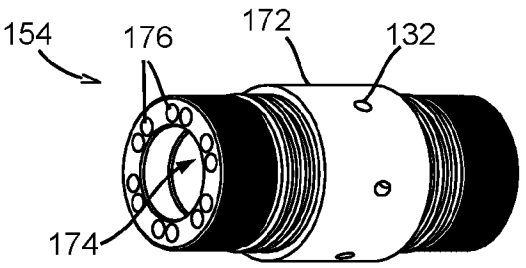
FIG. 4 is a perspective view of a flow diverter of the dual-tubing assembly of FIG. 3.
Figure 5:
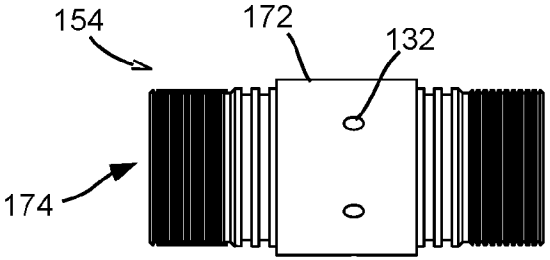
FIG. 5 is a side view of the flow diverter of FIG. 4.
Figure 6:
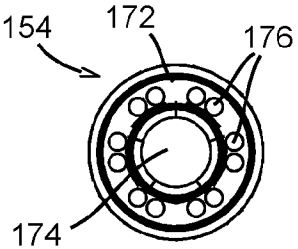
FIG. 6 is an end view of the flow diverter of FIG. 4.

With reference to FIG. 3, in one embodiment, the dual-tubing assembly 106 comprises, from an uphole direction to a downhole direction, a dual tubular structure 152, a flow diverter 154 and a bottom sub 156, mutually coupled to each other using suitable means such as threaded connections.

The dual tubular structure 152 comprises an outer tubing connector 162 and an inner tubing connector 164 received therein. The inner tubing connector 164 has an outer diameter (OD) smaller than the inner diameter (ID) of the outer tubing connector 162 to form a tubing annulus 124 therebetween.

In this embodiment, the outer tubing connector 162 is a tubular ported at its uphole end for sealably connecting to the outer tubing 102 and secured thereto using set screws. The outer tubing connector 162 also has inner female threading at its downhole end for mating matching, outer male threading at an uphole end of the flow diverter 154, to couple the outer tubing connector 162 to the flow diverter 154.

Similarly, the inner tubing connector 164 is a tubular ported at its uphole end for sealably connecting to the inner tubing 104 and secured thereto using set screws. The inner tubing connector 164 also has outer male threading at its downhole end for mating matching, inner female threading at an uphole end of the flow diverter 154, to couple the inner tubing connector 164 to the flow diverter 154.

As shown in FIG. 3, and also referring to FIGS. 4 to 8, the flow diverter 154 is a tubular for directing the driving fluid Fi downhole therethrough via one or more axially extending driving flow passages, and directing the circulation fluid Fg to the wellbore annulus 130 via one or more radially extending circulation flow passages.

The flow diverter 154 has outer and inner threading at its uphole end for coupling to the outer and inner tubing connectors 162 and 164, respectively. The flow diverter 154 also has outer male threading at its downhole end for coupling to matching, female threading of the bottom sub 156.

As shown in the embodiment of FIGS. 4 to 8, the flow diverter 154 comprises one or more circumferentially spaced driving fluid passages 176 in the body or wall 172 portion thereof, extending axially from the uphole end of the flow diverter 154 to the downhole end thereof. As will be described in more detail below, the one or more driving fluid passages 176 form part of the driving flow path 122.

The flow diverter 154 also comprises one or more circulation passages 132 extending generally radially outwardly from the bore 174 of the flow diverter 154 for fluidly connecting the bore 174 of the flow diverter 154 to the wellbore annulus 130. In this embodiment, the one or more circulation passages 132 are preferably angled towards an uphole direction. The one or more circulation passages 132 are part of the circulation flow path 142. The one or more circulation passages 132 are fluidly isolated from the one or more driving fluid passages 176 to separate the circulation flow path 142 from the driving flow path 122.

Figure 7:
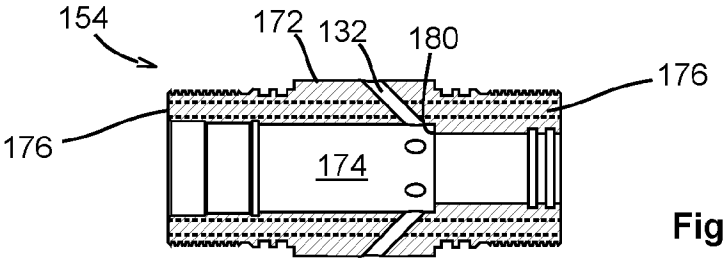
FIG. 7 is a cross-sectional view of the flow diverter of FIG. 4.
Figure 8:
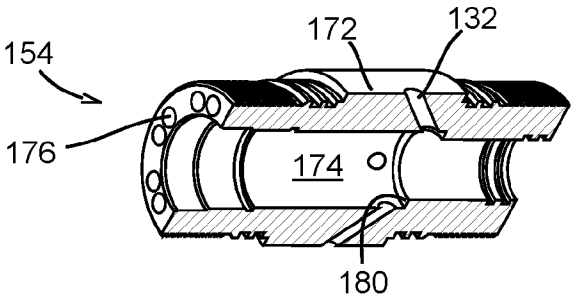
FIG. 8 is a cross-sectional perspective view of the flow diverter of FIG. 4.
Figure 9:
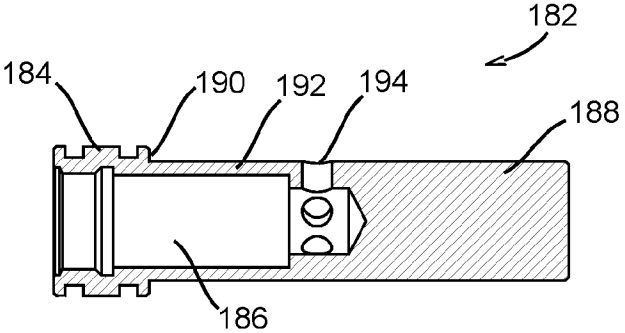
FIG. 9 is a cross-sectional view of a flow redirector of the dual-tubing assembly of FIG. 3 for coupling with the flow diverter of FIG. 4, and absent the ball seat and flapper valves.

As shown in FIGS. 7 and 8, the flow diverter 154 further comprises an uphole-facing shoulder 180 extending radially inwardly from the inner surface thereof into the bore 174 for delimiting the downhole position of a flow redirector 182 of FIG. 9.

Referring again to FIG. 3, the flow redirector 182 is received in the bore 174 of the flow diverter 154, and is fluidly sealably, axially moveable between an uphole, operation position for directing circulation fluid flow from the inner tubing 164 to the wellbore annulus 130, and a downhole, emergency mill release position for releasing the mill 114 in emergency situations.

As shown in FIG. 9, the flow redirector 182 is a cylinder having an open uphole end 184, and a closed downhole end 188. The flow redirector 182 also comprises a chamber 186 fluidly accessible from the open uphole end 184 and to one or more ports 194 on the ported side wall 192 thereof. The uphole end 184 is radially outwardly extended, forming a downhole-facing shoulder 190 for engaging the uphole-facing shoulder 180 to delimit the downhole movement and support the flow redirector 182 in the bore 174.

Referring back to FIG. 3, and described from uphole to downhole, the flow redirector 182 receives in the chamber 186 a ball seat 202 having a bore therethrough, and one or more (e.g., two shown in FIG. 3) one-way circulation valves 204, e.g., flapper valves, for only allowing a fluid flowing therethrough along a downhole direction and preventing fluid backflow.

As shown in FIG. 3, the bottom sub 156 is a tubular supporting a piston 212 and a piston cap or crossover 214 axially slidably and fluidly sealably received in a bore 210 thereof. The piston cap 214 is coupled to an uphole end of the piston 212 using suitable means such as threading. As shown, the piston 212 and piston cap 214 are normally locked at an uphole, operation position by shear pins (not shown) through one or more shear pin holes 220 on the body of the bottom sub 156 into recesses 222 on the body of the piston 212, and may be telescoped downhole in emergency situations for triggering the mill release sub 110 to release the mill 114.

The piston 212 is a tubular having a bore 216 for directing the driving fluid flow downhole. A downhole tubular portion 218 of the piston 212, which may be a downhole tubular coupled to the piston 212, has a reduced diameter, forming a downhole-facing shoulder for engaging an uphole facing should on the body of the bottom sub 156 to delimit the downhole position of the piston 212. Correspondingly, the bore 210 adjacent the downhole portion 218 of the piston 212 then forms a downhole chamber 228B for allowing the piston to axially move downhole and telescope out of the bottom sub 156. One or more equalization ports 224 on the downhole portion 218 are used for fluid equalization during piston telescoping.

In this embodiment, the piston 212 also receives in its bore 216 one or more (e.g., two shown in FIG. 3) one-way driving valves 226, e.g., flapper valves, for only allowing fluid flow downhole and preventing fluid backflow.

Figure 10:
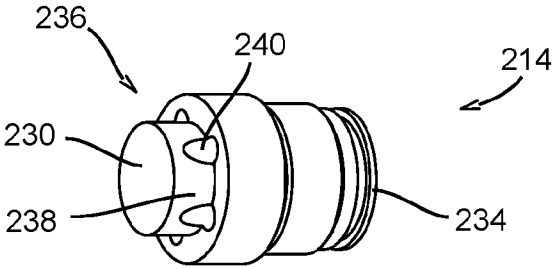
FIG. 10 is a perspective view of a piston cap of the dual-tubing assembly of FIG. 3 for mill release actuation.
Figure 12:
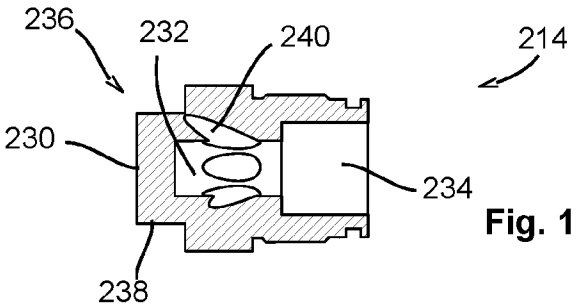
FIG. 12 is a cross-sectional view of the piston cap of FIG. 10.
Figure 11:
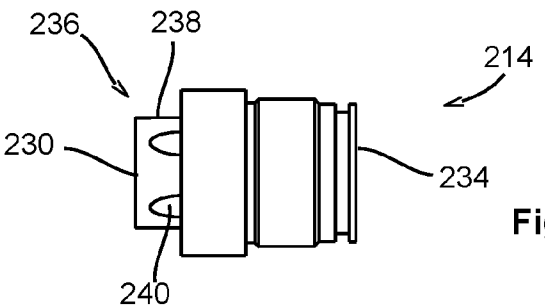
FIG. 11 is a side view of the piston cap of FIG. 10.

As shown in FIGS. 10 to 12, the piston cap 214 is a tubular having a closed upper end 230, a bore 232 and an open downhole end 234. An uphole portion 236 has a reduced diameter, and is ported on the side wall 238 thereof to form one or more ports 240 extending from the side wall 238 axially into the bore 232.

Referring again to FIG. 3, after assembling and in an operation configuration, the flow redirector 182 is located at an uphole position in the bore 174 of the flow diverter 154, adjacent the downhole end of the inner tubing connector 164 and is uphole delimited there to. The piston 212 and the piston cap 214 are also positioned at an uphole position in the bore 210 of the bottom sub 156, adjacent and preferably in contact with the flow redirector 182. One or more shear pins (not shown) are received in the shear pin holes 220 of the bottom sub 156, extending radially inwardly into the recesses 222 of the piston 212 to lock the piston 212 in position. As the uphole portion 236 of the piston cap 214 has a reduced diameter, the bore 210 adjacent the uphole portion 236 of the piston cap 214 then forms an uphole chamber 228A.

Figure 13:
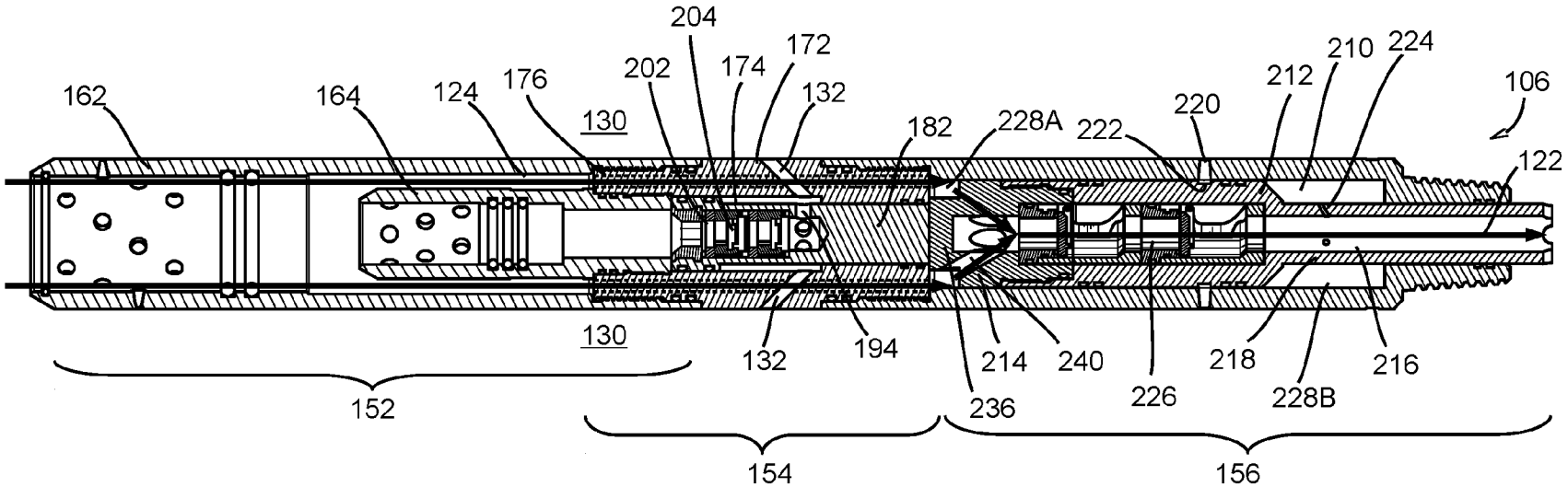
FIG. 13 is a cross-sectional view of the dual-tubing assembly of FIG. 3, showing a driving flow path for introducing an incompressible, driving fluid flow from surface to a hydraulic motor to drive a mill to drill obstructions.

With reference to FIG. 13, the driving flow path 122 is formed from the outer tubing 102 (see FIG. 1) through the tubing annulus 124, the one or more driving fluid passages 176, the uphole chamber 228A, the one or more ports 240 of the piston cap 214, the one or more driving flapper valves 226, the bore 216 of the piston 212, and the bore of intermediate subs (not shown) to the hydraulic motor 112. A liquid such as driving mud may be introduced from the surface via the driving flow path 122 to the hydraulic motor 112 for driving the mill 114.

Figure 14:
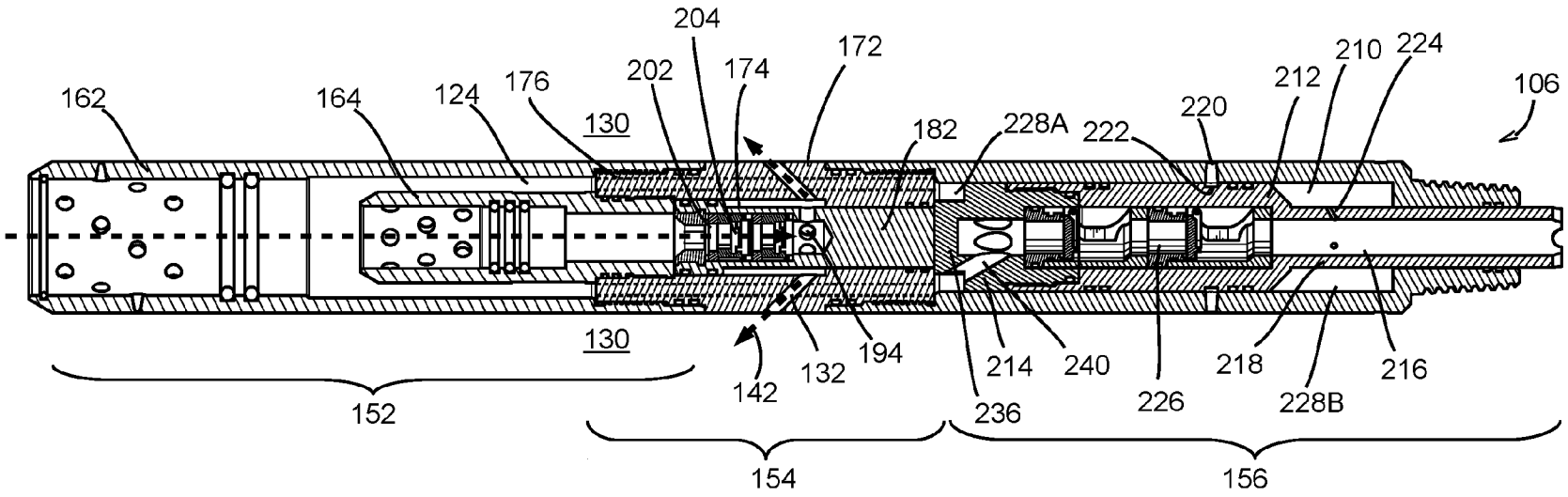
FIG. 14 is a cross-sectional view of the dual-tubing assembly of FIG. 3, showing a circulation flow path for introducing a compressible gas flow from surface into a wellbore annulus for circulating debris to surface.

As shown in FIG. 14, the circulation flow path 142 is formed from the inner tubing 104 (see FIG. 1) through the inner tubing connector 164, the ball seat 202, the one or more circulation flapper valves 204, the one or more ports 194 of the flow redirector 182, the bore 174 of the flow diverter 154, and the one or more circulation passages 132 to the wellbore annulus 130. A gas may be introduced from the surface via the circulation flow path 142 into the wellbore annulus 130 for circulating debris to the surface.

Figure 15:
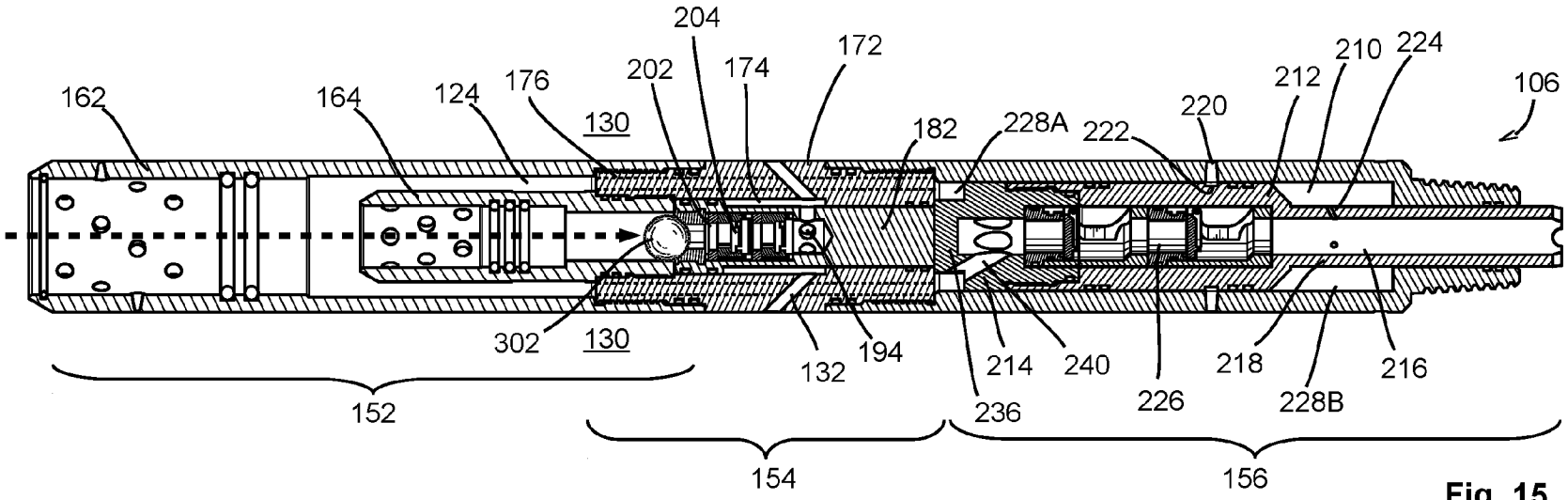
FIG. 15 is a cross-sectional view of the dual-tubing assembly of FIG. 3, showing a ball being dropped into the dual-tubing assembly for blocking the ball seat and releasing the mill in an emergency situation.
Figure 16:
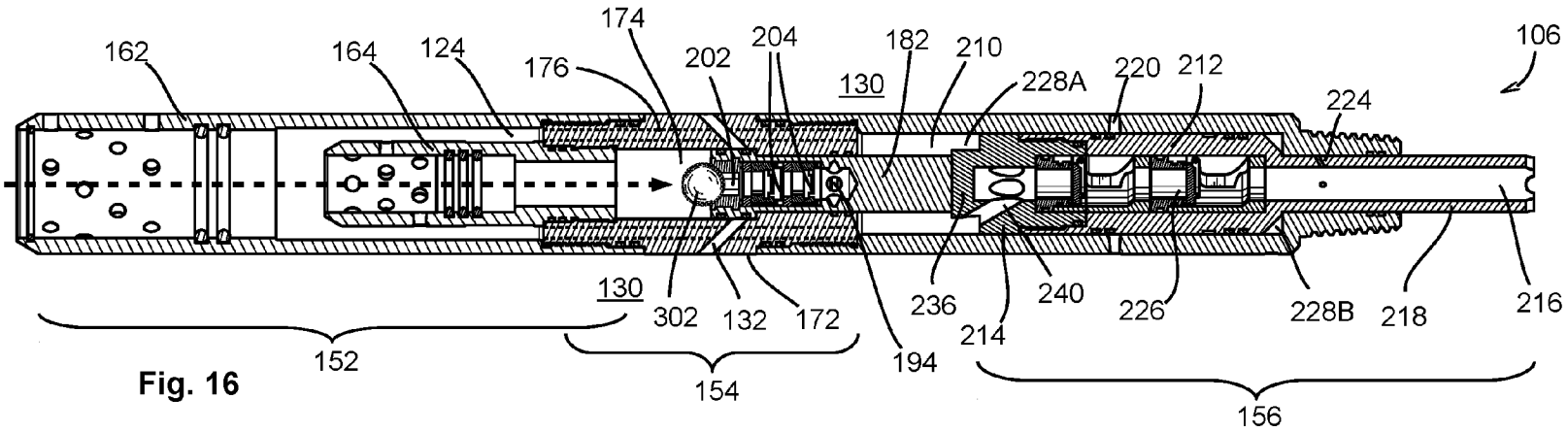
FIG. 16 is a cross-sectional view of the dual-tubing assembly of FIG. 15, showing that the piston of the dual-tubing assembly has been actuated downhole after the ball is dropped.

In an emergency situation such as when the mill 114 is stuck in the wellbore, the tubing string may be pulled uphole to release the mill 114. If, however, it is determined that the uphole pulling force is insufficient to release the mill 114, as shown in FIG. 15, a ball 302 may be dropped downhole and introduced through the inner tubing string 104. The ball 302 seats on the ball seat 202, and blocks the gas flow. Gas is then accumulated uphole of the ball 302 and becomes highly pressurized. The high pressure gas then applies a downhole force to the fluid face of the flow redirector 182, which in turn applies the downhole force to the piston 212. When the downhole force on piston 212 grows to a level sufficient for shearing the shear pins in the holes 220, the piston 212 is released downhole. The downhole tubular portion 218 of the piston 212 then extends or telescopes out of the bottom sub 156, as shown in FIG. 16, to trigger the milling release sub 108 of FIG. 1, to release the mill 114. During the downhole movement of the piston 212, any fluid in the downhole chamber 228B is discharged into the bore 216 of the downhole tubular portion 218 via the equalization ports 224 to release the fluid in the downhole chamber 228B and prevent hydraulic resistance of the downhole movement of the piston 212.

Those skilled in the art appreciate that alternative embodiments are readily available. For example, in an alternative embodiment, the flow redirector 182 needs not include any circulation flapper valves 204. In another embodiment, the piston 212 needs not include any driving flapper valves 226.

Figure 17:
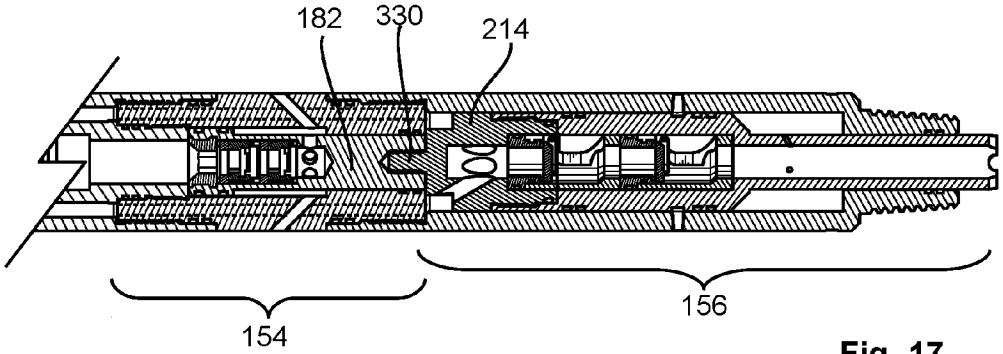
FIG. 17 is a cross-sectional view of a portion of the dual-tubing assembly of the downhole tool of FIG. 1 according to an alternative embodiment, showing the flow diverter and the bottom sub.

In yet another embodiment as shown in FIG. 17, the flow redirector 182 is coupled to the piston cap 214 via suitable fastening means such as bolt 330.

In still another embodiment, the flow redirector 182 is axially and sealably locked in the flow diverter 154. The bottom sub 156 does not comprise piston 212, nor piston cap 214. In this embodiment, other mill release methods and related downhole devices may be used for releasing the mill 114 in emergency situations.

In above embodiments, using an inner tubing 104 for the circulation flow path 142 and using an outer tubing 102 for the driving flow path 122, the inner tubing 104 may have a much smaller diameter than that of the outer tubing 102. A larger annular cross sectional area of the driving flow path 122, than that of the circulation flow path 142, provides sufficient hydraulic power to drive the mill. Considering the long length of the outer and inner tubings 102 and 104, the above embodiments thus provide an advantage of lower tubing cost and lower tubing weight.

Figure 18:
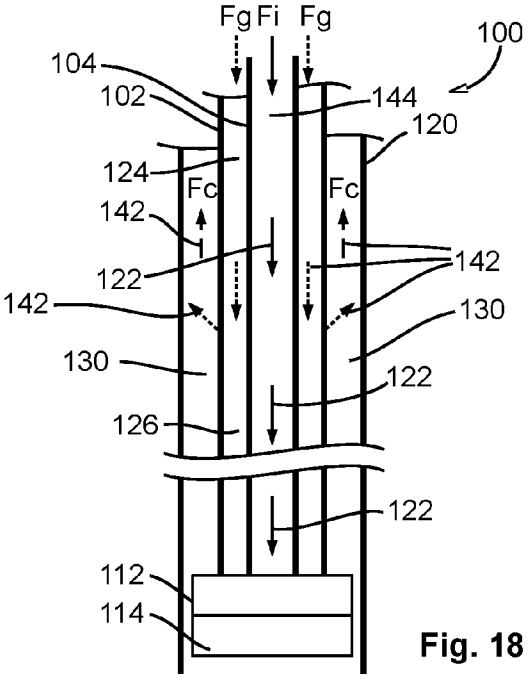
FIG. 18 is a schematic cross-sectional view of the structure of the downhole tool of FIG. 1, according to an alternative flow path embodiment.

With reference to FIG. 18, in an alternative embodiment, however, the inner tubing may be used for the driving flow path, and the outer tubing may be used for the circulation path. It can be seen that an advantage of this embodiment is that the downhole tool 100 has a simpler structure, e.g., not requiring a flow diverter. However, the inner tubing 104 in this embodiment must have a sufficiently large diameter to provide sufficient hydraulic power to drive the mill 114. Consequently, the cost of the larger-diameter, inner tubing 104 may exceed the costing saving of the simpler structure of the downhole tool 100, giving rise to a higher total cost and greater tubing weight.

In some alternative embodiments, the driving fluid, circulation fluid or both may liquid or gas, depending on the design.

In some alternative embodiments, a vacuum, such as that disclosed in Applicant's PCT Publication No. WO/2014/161073, may be located in the wellbore annulus 130 for suctioning the debris to surface, enhancing the circulation performance.

Although embodiments have been described above with reference to the accompanying drawings, those of skill in the art will appreciate that variations and modifications may be made without departing from the scope thereof as defined by the appended claims.

What is claimed is:

1. A downhole apparatus for clearing a wellbore, comprising:

a first tubing forming a first flow path;

a second tubing, the first tubing received in a bore of the second tubing, and forming a second flow path along the annulus formed therebetween;

a flow diverter connecting distal ends of the first and second tubing;

a mill connected to a downhole end of the flow diverter; wherein the flow diverter comprises a driving flow path therethrough and in fluid communication with the mill, and a circulation flow path in fluid communication with an annulus of the wellbore;

a mill release sub coupled to and intermediate to the flow diverter and the mill; and a piston intermediate to the flow diverter and the mill release sub, the piston axially actuatable, by the circulation flow path through to the flow diverter, between a first position for normal operation and a second position for triggering the mill release sub to release the mill.

2. The apparatus of claim 1 wherein the first flow path is the circulation flow path and the second flow path is the driving flow path.

3. The apparatus of claim 1 wherein the flow diverter further comprises a flow redirector axially movable between a third position for directing the circulation flow into the annulus of the wellbore and a fourth position for actuating the piston to telescope downhole for releasing the mill.

4. The apparatus of claim 3 wherein the flow redirector further comprises a ball seat for receiving a ball through the first tubing for actuating the flow redirector to move to the fourth position.

5. The apparatus of claim 4 wherein the flow redirector further comprises one or more one-way valves for only allowing fluid to flow downhole.

6. The apparatus of claim 4 wherein the piston further comprises a bore and one or more ports for directing driving fluid flow into the bore of the piston.

7. The apparatus of claim 6 wherein the piston further comprises one or more one-way valves for only allowing fluid to flow downhole.

8. A method of clearing obstructions in a wellbore, comprising:

locating a mill in the wellbore about the obstructions;

introducing a driving fluid flow along a driving flow path from surface to downhole for driving the mill;

introducing a circulation fluid flow along a circulation flow path from surface into the wellbore annulus at a location in the wellbore above the mill;

driving the mill using introduced driving fluid flow to mill the obstructions; and circulating milled obstructions to the surface via the wellbore annulus using the introduced circulation fluid flow; wherein at least a portion of one of the circulation and the driving flow paths is within the other one of the circulation and the driving flow paths and the method further includes, blocking the circulation flow path to release the mill into the wellbore, wherein blocking the circulation flow path actuates a piston from an uphole locked position to a downhole unlocked position to release the mill.

9. The method of claim 8 wherein at least a portion of the circulation flow path is within the driving flow path.

10. The method of claim 8, wherein blocking the circulation flow path comprises triggering the closure of a valve.

11. The method of claim 10, wherein triggering the closure of a valve comprises engaging a ball within a ball valve seat.

* * * * *